US006595172B2

(12) United States Patent
Kabasin et al.

(10) Patent No.: US 6,595,172 B2
(45) Date of Patent: Jul. 22, 2003

(54) VARIABLE VALVE ACTUATOR ASSEMBLY HAVING A SECONDARY ACTUATOR

(75) Inventors: Daniel F. Kabasin, Rochester, NY (US); John Castellana, Fairport, NY (US)

(73) Assignee: Delphi Technologies, Inc., Troy, MI (US)

( * ) Notice: Subject to any disclaimer, the term of this patent is extended or adjusted under 35 U.S.C. 154(b) by 14 days.

(21) Appl. No.: 09/854,782

(22) Filed: May 14, 2001

(65) Prior Publication Data

US 2002/0166523 A1 Nov. 14, 2002

(51) Int. Cl.[7] ..... F01L 1/34

(52) U.S. Cl. ..... 123/90.16; 123/90.15; 74/661

(58) Field of Search ..... 123/90.15, 90.16, 123/90.17; 74/661, 665 A, 665 B, 665 C, 665 D; 92/2

(56) References Cited

U.S. PATENT DOCUMENTS

| | | | | |
|---|---|---|---|---|
| 3,225,626 A | * | 12/1965 | Geyer | 74/661 |
| 3,797,623 A | * | 3/1974 | Gregorovich et al. | 192/146 |
| 4,577,738 A | * | 3/1986 | Yater | 192/18 A |
| 4,881,502 A | | 11/1989 | Kabasin | |
| 4,968,239 A | * | 11/1990 | Inaba et al. | 100/273 |
| 5,085,071 A | * | 2/1992 | Mizushina et al. | 73/118.1 |
| 5,094,280 A | * | 3/1992 | Kahilahti et al. | 144/162.1 |
| 5,628,234 A | * | 5/1997 | Crook et al. | 475/1 |
| 5,924,334 A | * | 7/1999 | Hara et al. | 123/90.17 |
| 5,937,809 A | | 8/1999 | Pierik et al. | |
| 6,022,290 A | * | 2/2000 | Lyon | 180/65.2 |

* cited by examiner

*Primary Examiner*—Thomas Denion
*Assistant Examiner*—Jaime Corrigan
(74) *Attorney, Agent, or Firm*—Patrick M. Griffin

(57) ABSTRACT

A variable valve actuator assembly includes a main actuator, a secondary actuator and an actuator shaft. The actuator shaft is coupled to each of the main actuator and the secondary actuator. The main actuator and the secondary actuator are each separately and independently selectable for driving the actuator shaft to rotate.

10 Claims, 3 Drawing Sheets

VARIABLE VALVE ACTUATOR ASSEMBLY HAVING A SECONDARY ACTUATOR

TECHNICAL FIELD

The present invention relates generally to variable valve trains of internal combustion engines and, more particularly, to actuating assemblies of variable valve trains.

BACKGROUND OF THE INVENTION

Conventional internal combustion engines utilize two throttling devices, i.e., a throttle valve and the intake valves of the engine. The throttle valve is actuated by a driver depressing and/or releasing the gas pedal, and regulates the air flow to the intake valves. The engine intake valves are driven by the camshaft of the engine. The intake valves open and close at predetermined angles of camshaft rotation to allow the descending piston to draw air into the combustion chamber. The opening and closing angles of the valves and the amount of valve lift is fixed by the cam lobes of the camshaft. The valve lift profile (i.e., the curve of valve lift plotted relative to rotation of the camshaft) of a conventional engine is generally parabolic in shape.

Modern internal combustion engines may incorporate more complex and technologically advanced throttle control systems, such as, for example, electronically controlled throttle systems and intake valve throttle control systems. Electronically controlled throttle systems, in general, eliminate the mechanical link between the gas pedal and the upstream throttle by substituting an electronic sensor to communicate driver input (i.e., gas pedal position) to an engine control module. The engine control module, in turn, electronically controls the position of the upstream throttle. Intake valve throttle control systems, in general, control the flow of gas and air into and out of the cylinders of an engine by varying the timing and/or lift (i.e., the valve lift profile) of the intake valves in response to engine operating parameters, such as, for example, engine load, speed, and driver input. Intake valve throttle control systems vary the valve lift profile through the use of various mechanical and/or electro-mechanical configurations, generally referred to herein as variable valve mechanisms. Examples of a variable valve mechanisms are detailed in commonly-assigned U.S. Pat. No. 5,937,809, the disclosure of which is incorporated herein by reference. Generally, and as will be described more particularly hereinafter, a variable valve mechanism includes a control shaft that is rotatable by an actuator to thereby vary valve timing, duration and lift.

Despite the advanced technology used in and the reliability of modern throttle control systems, the contingency of malfunction and even failure must be considered. Malfunction and/or failure of the actuator of a variable valve mechanism results in the engine either stalling completely or, at best, continuing to run at a very low output level due to an improper air-to-fuel ratio. A variable valve mechanism having a failed actuator will be unresponsive to driver input seeking to actuate the throttle in order to increase speed or engine output. Thus, the operator of the vehicle may be unable to restart the vehicle, to "limp home", or to drive to the nearest repair station.

The actuator in a variable valve mechanism must be capable of providing a minimum angular rotation within a maximum period of time in order to provide appropriate response to driver input and to achieve satisfactory system performance. In order to conform to such a specification, an actuator may sacrifice resolution, i.e., the capability of making small or fine adjustments in rotational position, in the interest of rotational speed. Thus, the actuator may not be capable of making fine adjustments in the angular position of the control shaft. A variable valve mechanism having such an actuator may be incapable of finely tuning the valve lift profile. Inability to finely tune the valve lift profile can result in rough engine idle and a decrease in system and/or engine efficiency.

Therefore, what is needed in the art is an apparatus that provides a limp home capability to a variable valve mechanism.

Furthermore, what is needed in the art is an apparatus that provides driver control over a variable valve mechanism having a failed main actuator.

Moreover, what is needed in the art is an apparatus that provides the capability to finely tune and/or adjust the valve lift profile of a variable valve mechanism.

SUMMARY OF THE INVENTION

The present invention provides a variable valve actuating assembly including a secondary actuator.

The invention comprises, in one form thereof, a variable valve actuator assembly including a main actuator, a secondary actuator and an actuator shaft. The actuator shaft is coupled to each of the main actuator and the secondary actuator. The main actuator and the secondary actuator are each separately and independently selectable for rotating the actuator shaft.

An advantage of the present invention is that the secondary actuator provides for actuation of the control shaft, and thereby adjustment of the valve lift profiles, in the event of a failure of the main actuator.

Another advantage of the present invention is that the secondary actuator enables fine tuning of the valve lift profiles under engine idle conditions.

A still further advantage of the present invention is that the secondary actuator enables a driver to restart and drive a vehicle having an engine in which the main actuator has failed.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
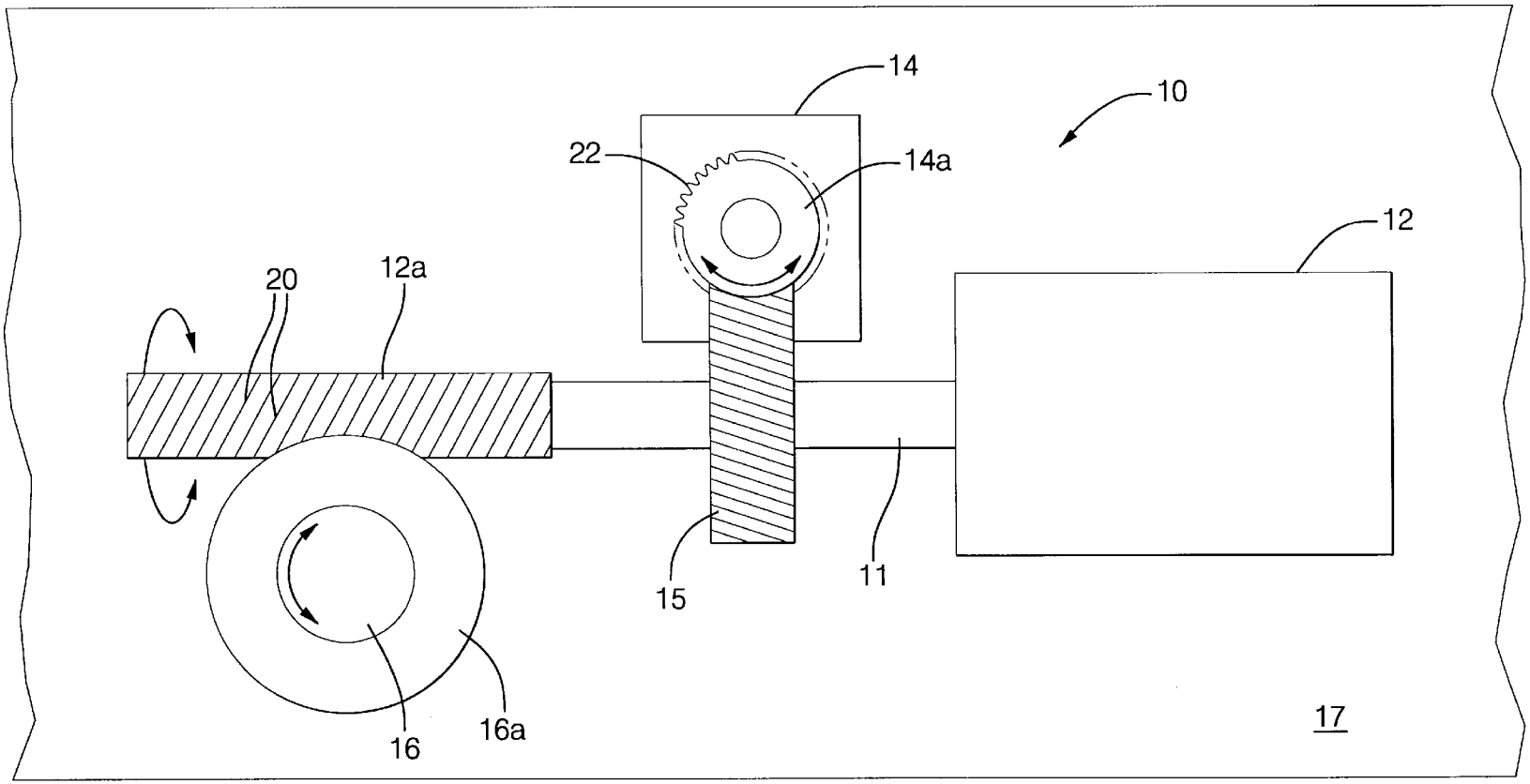
FIG. 1 is a block diagram of the variable valve actuator assembly having a main actuator and a secondary actuator of the present invention.

Referring now to the drawings and particularly to FIG. 1, there is shown one embodiment of a variable valve actuator assembly having a secondary actuator of the present invention.

Variable valve actuator assembly 10 includes actuator shaft 11, main actuator 12, main output gear 12*a*, secondary actuator 14 having secondary output gear 14*a*, secondary shaft gear 15, control shaft 16 and control shaft gear 16*a*.

Main actuator 12 selectively drives rotation of control shaft 16. More particularly, main actuator 12 selectively rotates actuator shaft 11. The rotation of actuator shaft 11 is transferred, via main output gear 12*a* and control shaft gear 16*a*, to control shaft 16. Main actuator 12 also drives secondary output gear 14*a* via secondary shaft gear 15 under normal engine operating (i.e., non-failure and/or non-idle) conditions. Secondary actuator 14 and secondary output gear 14*a* are capable of being driven in a forward and backward direction by the rotation of actuator shaft 11. Main actuator 12 is selected to be appropriately powered such that it is capable of driving both control shaft 16 and secondary actuator 14, so long as secondary actuator 14 is in an unpowered condition, throughout the entire range of anticipated operating parameters of internal combustion engine 17. Further, main actuator 12 is selected such that it is capable of rotating control shaft 16 through a minimum range of rotation within a desired maximum response time, such as, for example seventy-two degrees of rotation of control shaft 16 within 300 mS. Main actuator 12 is, for example, a direct current (DC) motor driving a gear box (not shown) which, in turn, drives main output gear 12*a* and secondary shaft gear 15.

Main output gear 12*a* is, for example, formed integrally with or fixedly secured to actuator shaft 11. Main output gear 12*a* is driven to rotate by main actuator 12. Main output gear 12*a* is, for example, a self locking, single pitch worm gear. Main output gear 12*a* has self-locking gear teeth 20 formed thereon. Teeth 20 are relatively widely spaced, and therefore main output gear 12*a* has a relatively large circular pitch (circular pitch is defined as the distance from the center of one tooth to the center of the next tooth as measured at the circumference of the pitch circle). Main output gear 12*a* engages engage control shaft gear 16*a*. As main output gear 12*a* is rotated teeth 20 engage teeth (not shown) on control shaft gear 16*a* to thereby rotate control shaft 16.

Secondary actuator 14 is also capable of selectively driving the rotation of control shaft 16. More particularly, secondary actuator 14 drives secondary output gear 14*a* which, in turn, drives secondary shaft gear 15 and rotates actuator shaft 11. The rotation of actuator shaft 1 is transferred, via main output gear 12*a* and control shaft gear 16*a*, to control shaft 16. Secondary actuator 14 is configured as, for example, a direct current (DC) motor driving a gear box (not shown) which, in turn, drives secondary output gear 14*a*. Secondary actuator 14 is capable of driving secondary output gear 14*a* in a forward and a backward direction, and is thus capable of rotating control shaft 16 in either a forward or backward direction. Secondary actuator 14 is selected to be adequately powered to rotate control shaft 16 and main actuator 12, so long as main actuator 12 is in an unpowered condition.

Secondary output gear 14*a* includes non-locking gear teeth 22. Teeth 22 are closely-spaced relative to teeth 20 of main output gear 12*a*. For example, secondary output gear 14*a* has four times as many teeth per inch relative to main output gear 12*a* and therefore has a small circular pitch relative to main output gear 12*a*. Thus, secondary actuator 14, driving secondary output gear 14*a* having finely-spaced teeth 22, has a substantially higher resolution and rotates control shaft 16 in substantially smaller increments than main actuator 12. Conversely, main actuator 12 rotates control shaft 16 in relatively large increments by driving main output gear 12*a* having relatively widely-spaced gear teeth 20. Under engine idle operating conditions, higher-resolution secondary actuator 14 is used to fine tune the valve lift profile of engine 17 by adjusting in small increments the position of control shaft 16, as initially and approximately set by main actuator 12. Further, the relatively fine spacing of gear teeth 22 enable secondary actuator 14 to be of a lower power than main actuator 12, and thus of lighter weight.

Secondary shaft gear 15 is, for example, formed integrally with or fixedly secured to actuator shaft 11. Secondary shaft gear 15 engages secondary output gear 14*a*. Control shaft 16 is coupled to main output gear 12*a* by control shaft output gear 16*a*.

Figure 2:
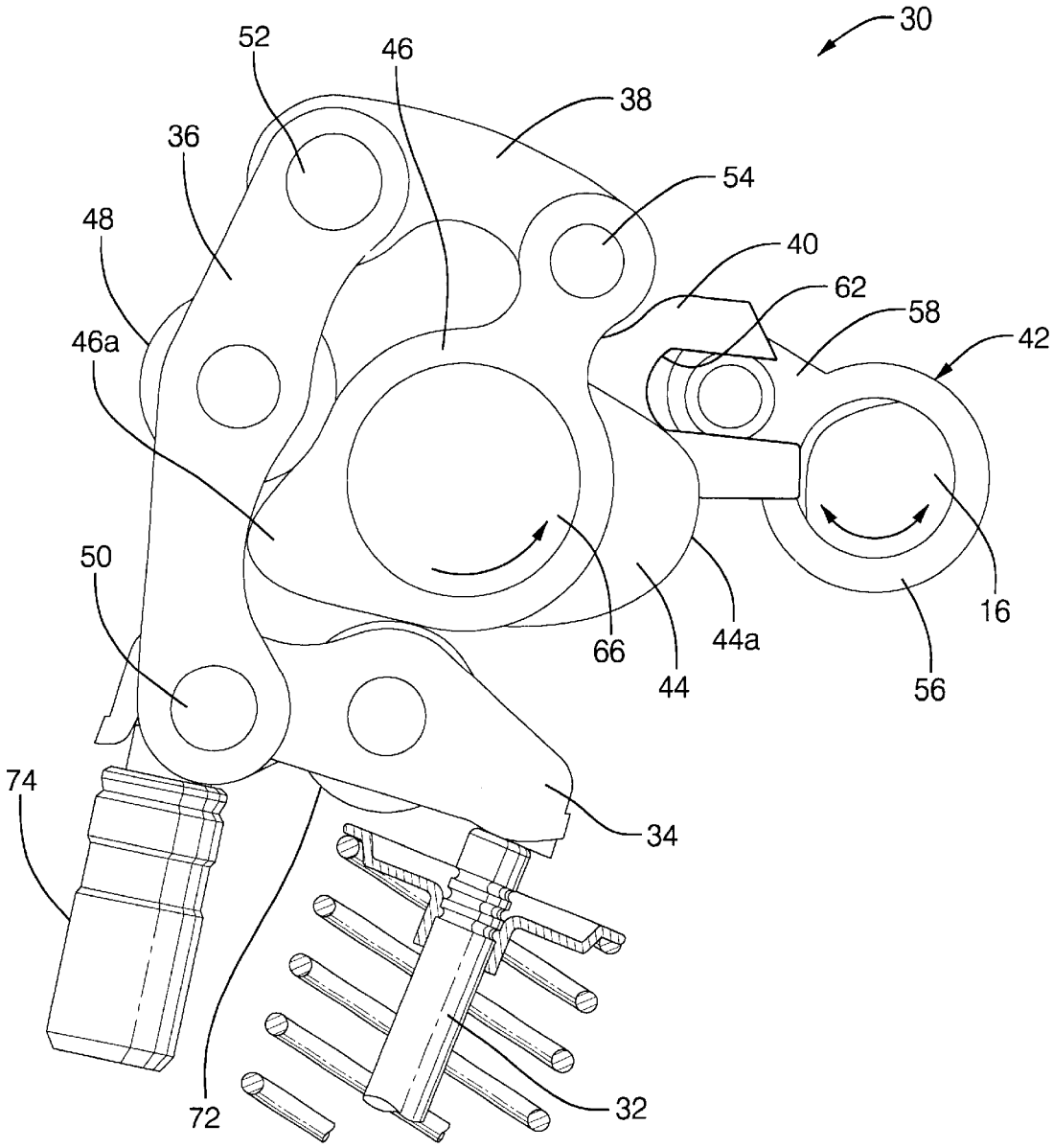
FIG. 2 is a perspective view of a variable valve mechanism in a maximum lift position.
Figure 3:
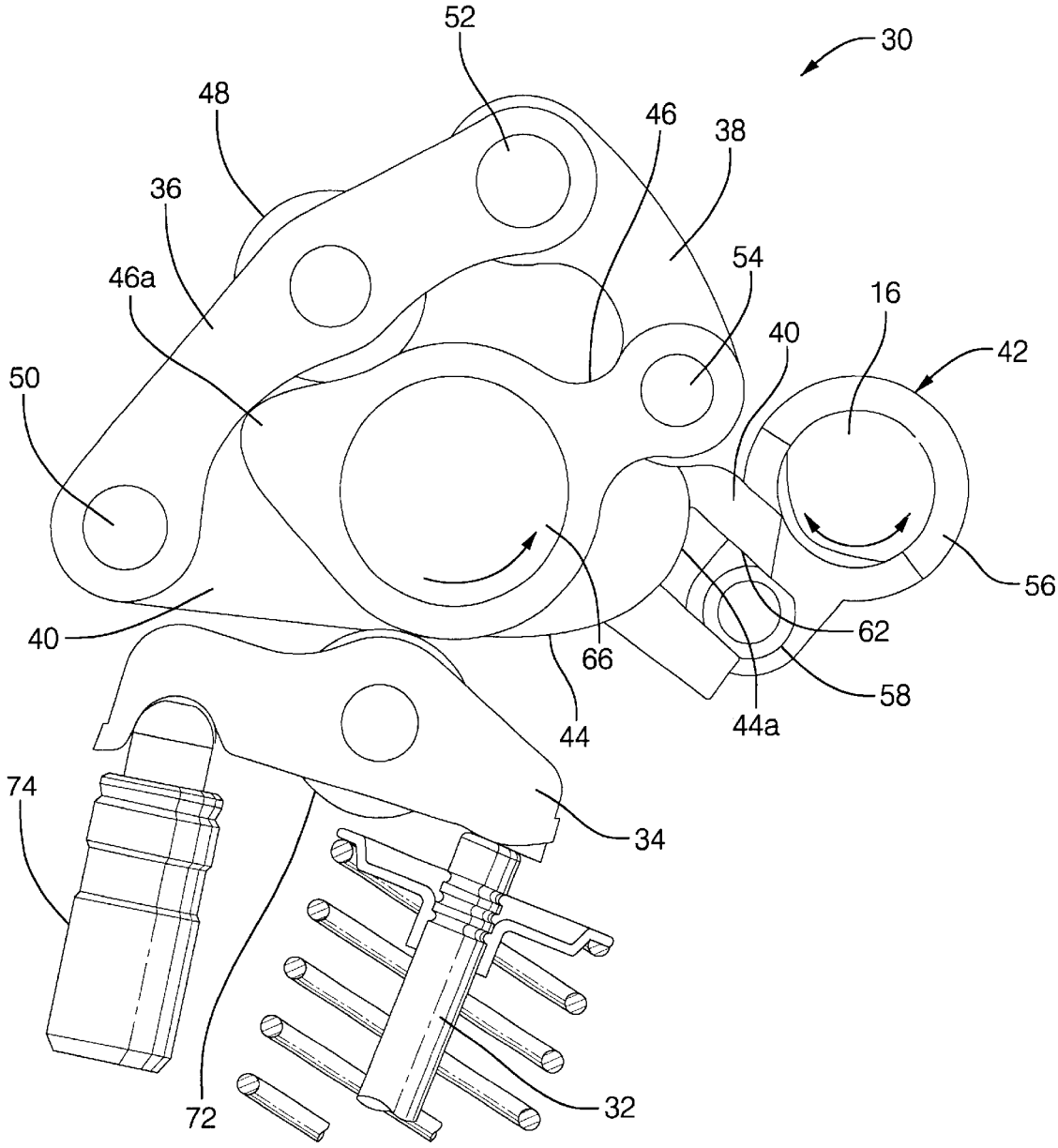
FIG. 3 is a perspective view of a variable valve mechanism in a minimum lift position.

Referring now to FIGS. 2 and 3, control shaft 16 extends axially from main output gear 12*a* and is coupled, as will be explained more particularly hereinafter, to variable valve mechanism 30. Thus, variable valve actuator assembly 10 is coupled to variable valve mechanism 30. It should be noted that the structure and elements of variable valve mechanism 30 are presented for the purpose of illustrating the operation and interrelationship of variable valve actuator assembly 10 with one embodiment of a variable valve mechanism. Further, it should be noted that actuator assembly 10 may be coupled to numerous and differently-configured variable valve mechanisms, and that the particular configuration of variable valve mechanism 30 is not to be construed as limiting the application of variable valve actuator assembly 10 to any particular configuration of variable valve mechanism.

Variable valve mechanism 30 includes valve 32, roller finger follower (RFF) 34, primary lever or rocker 36, link 38, control member 40, control shaft linkage 42, rotary cam 44 and oscillating cam 46. Variable valve mechanism 30 reciprocates valve 32. Valve 32 is, for example, an intake valve of internal combustion engine 17.

Primary rocker 36 includes rotary roller 48, frame pivot pin 50 and link pin 52. Rotary roller 48 is attached to and carried by primary rocker 36. Rotary roller 48 is engaged by rotary cam 44, as will be described in more detail hereinafter. Frame pivot pin 50 pivotally couples primary rocker 36 to control member 40 (only a portion of control member 40 is shown in FIG. 2 for clarity). Link pin 52 couples primary rocker 36 to link 38 which, in turn, is coupled to oscillating cam 46 via oscillating cam pin 54.

Control shaft linkage 42 includes control shaft clamp 56 and control shaft crank pin 58. Control shaft linkage 42 couples control shaft 16 to variable valve actuator assembly 10. Control shaft clamp 56 is attached to control shaft 16, such as, for example, by clamping. Control shaft crank pin 58 is attached to and carried by control shaft clamp 56, and is received within slot 62 of control member 40.

Control member 40 is rotationally mounted to camshaft 66. Control member 40 is not rotated by camshaft 66, but does rotate around the central axis (not referenced) of camshaft 66. Control member 40 is coupled to primary rocker 36 via frame pivot pin 50, and is coupled to control shaft linkage 42 via control shaft crank pin 58. The portion of control member 40 that is coupled to primary rocker 36 at pivot pin 50 has been omitted from FIG. 2 for the sake of clarity.

Rotary cam 44 is coupled to or formed integrally with camshaft 66. Thus, the rotation of camshaft 66 results in a corresponding rotation of rotary cam 44. Rotary cam 44 includes rotary cam lobe 44*a*. Rotation of rotary cam 44, in turn, displaces rotary roller 48 according to the lift profile of rotary cam lobe 44*a*.

Oscillating cam 46 is rotationally mounted upon camshaft 66. Oscillating cam 46 is rotatable relative to and around the central axis (not referenced) of camshaft 66. However, oscillating cam 46 is not rotated by camshaft 66. Rather, oscillating cam 46 is rotated via the rotation of rotary cam 44. More particularly, as rotary cam 44 rotates, rotary cam lobe 44*a* engages rotary roller 48. Primary rocker 36 is displaced in a generally-radial direction relative to camshaft 66 according to the lift profile of rotary cam lobe 44*a*. The displacement of primary rocker 36, in turn, is transferred via link pin 52 to a corresponding displacement of link 38. The displacement of link 38 is transferred by oscillating cam pin 54 to a corresponding degree of rotation of oscillating cam 46 relative to the central axis of camshaft 66. Thus, the amount by which oscillating cam 46 rotates about the central axis of camshaft 66 is determined by the lift profile of rotary cam lobe 44*a*.

In use, variable valve actuator assembly 10 determines the valve lift profile of valve 32 of variable valve mechanism 30. In general, the valve lift profile of valve 32 is determined or initially set by the rotation of control shaft 16 by main actuator 12 to thereby place oscillating cam lobe 46*a* and follower roller 72 in a predetermined angular/rotational relationship (i.e., the rotational proximity of oscillating cam lobe 46*a* and follower roller 72 is determined by the rotation of control shaft 16). More particularly, rotation of control shaft 16 rotates control shaft linkage 42. Rotation of control shaft linkage 42 is transferred by control shaft crank pin 58 to control member 40 to thereby establish a predetermined rotational position of control member 40 relative to the central axis of camshaft 66 (as stated above, only a portion of control member 40 is shown in FIG. 2 for clarity). The rotation of control member 40 is transferred through frame pivot pin 50 to a corresponding rotation of primary rocker 36 relative to camshaft 66. The rotation of primary rocker 36 is transferred through link pin 52 to rotation of link 38. The rotation of link 38 is transferred by oscillating cam pin 54 to rotation of oscillating cam 46 to thereby establish the rotational position of oscillating cam lobe 46*a* relative to follower roller 72. Once the desired position of oscillating cam lobe 46*a* relative to follower roller 72 is established, the rotation of control shaft 16 is ceased. Control shaft 16 maintains oscillating cam 46 in the desired position by precluding the rotation of control member 40 about the central axis of camshaft 66.

The valve lift profile of valve 32 is determined by the angular/rotational proximity of oscillating cam lobe 46*a* to follower roller 72 and, thus, by the rotation of control shaft 16. By comparing the angular position of oscillating cam lobe 46*a* relative to follower roller 72 in FIG. 2 to the angular position of oscillating cam lobe 46*a* relative to follower roller 72 in FIG. 3, the effect of the angular or rotational proximity of oscillating cam lobe 46*a* to follower roller 72 upon the valve lift profile is readily understood. Referring now specifically to FIG. 2, it is seen that oscillating cam lobe 46*a* is positioned in relatively close rotational/angular proximity to follower roller 72. Thus, a relatively slight rotation, such as, for example, forty degrees, of oscillating cam 46 results in a substantial portion of oscillating cam lobe 46*a* engaging follower roller 72. The engagement of follower roller 72 by oscillating cam lobe 46*a* causes RFF 34 to pivot about lash adjuster 74. The amount of pivot of RFF 34 corresponds to the portion of oscillating cam lobe 46*a* which engages follower roller 72. The pivoting of RFF 34, in turn, causes a corresponding displacement or reciprocation of valve 32. In fact, with oscillating cam lobe 46*a* positioned relative to follower roller 72 as shown in FIG. 2, oscillating cam lobe 46*a* engages follower roller 72 up to approximately the peak (not referenced) of oscillating cam lobe 46*a* thereby resulting in a substantial pivoting of RFF 34 and a correspondingly substantial amount of displacement of valve 32.

In contrast, and as shown in FIG. 3, oscillating cam lobe 46*a* is positioned relatively distant from follower roller 72. Thus, a relatively slight rotation, such as, for example, forty degrees, of oscillating cam 46 results in the base circle (i.e., the zero lift portion) of oscillating cam 46 engaging follower roller 72 for a substantial portion of the rotation of oscillating cam 46. Only the zero lift portion or a low lift portion of output cam lobe 46*a* engages follower roller 72 during the rotation of oscillating cam 46. Thus, follower roller 72 is displaced only slightly due to only the zero or low-lift portion of oscillating cam lobe 46*a* engaging follower roller 72. Therefore, valve 32 is displaced or reciprocated a correspondingly slight amount.

Actuation of valve 32 is accomplished indirectly by the rotation of rotary cam 44. Rotary cam 44 is rotated a full 360 degrees (three-hundred sixty degrees) by camshaft 66. Rotary cam 44 engages rotary roller 48. As rotary cam 44 is rotated by camshaft 66, rotary roller 48 is displaced according to the lift profile of input cam 44. The displacement of rotary roller 48 causes a corresponding displacement of primary rocker 36. The displacement of primary rocker 36 is transferred to link 38 via link pin 52. Thus, primary rocker 36 pulls link 38 in a generally-axial direction. The pulling of link 38 is transferred through output cam pin oscillating cam pin 54 to oscillating cam 46, thereby causing oscillating cam 46 to rotate about camshaft 66 an amount corresponding to the lift profile of rotary cam 44. Oscillating cam 46 engages roller follower 72. Follower roller 72 is displaced according to the lift profile of that portion of oscillating cam 46 which engages follower roller 72. As described above, the portion of the lift profile of oscillating cam 46 which engages follower roller 72 is determined by the rotational proximity of oscillating cam lobe 46*a* relative to follower roller 72 as established by the rotation of control shaft 16. A return spring (not shown) pulls or returns primary rocker 36 and oscillating cam 46 to thereby place oscillating cam lobe 46*a* into the angular/rotational position as determined by the rotational position of control shaft 16.

As described above, main actuator 12 determines the valve lift profile of variable valve mechanism 30 by setting the position of oscillating cam lobe 46*a* relative to follower roller 72 through the rotation of control shaft 16. Thereafter, primary actuator 12 is depowered. Secondary actuator 14 thereafter rotates control shaft 16 to make fine adjustments in the rotational position of oscillating cam lobe 46*a* relative to follower roller 72. Further, in the event of a failure of main actuator 12, secondary actuator 14 is used to provide limited control over the valve lift profile of variable valve mechanism 30 and to provide a limp home capability. Secondary actuator 14 rotates control shaft 16 by rotating secondary output gear 14*a*. Rotation of secondary output gear 14*a* is transferred through secondary shaft gear 15 and actuator shaft 11 to rotation of main output gear 12*a*. Rotation of main output gear 12*a* is transferred via control shaft gear 16*a* to control shaft 16 to thereby adjust the rotational position of oscillating cam lobe 46*a* relative to follower roller 72 and, thus, the valve lift profile of variable valve mechanism 30.

The fine adjustment in the valve lift profile of variable valve mechanism 30 is performed by secondary actuator 14 when main actuator 12 is depowered and in response to, for example, electrical signals received from an engine control unit or computer (not shown). Secondary actuator 14 performs this fine adjustment, for example, under engine idle operating conditions. The fine adjustment or fine tuning is enabled by virtue of the relatively fine gear teeth 22 of secondary output gear 14*a*. Further, secondary actuator 14 rotates control shaft 16 to adjust the rotational position of oscillating cam lobe 46*a* relative to follower roller 72, and thereby adjust the valve lift profile of variable valve mechanism 30, under a range of engine operating conditions to maximize the efficiency of variable valve mechanism 30 and engine 17.

Upon failure of main actuator 12, secondary actuator 14 is used to provide driver control of the intake valve throttle control system. Failure of main actuator 12 or failure of control shaft 16 to rotate is detected by, for example, an engine control module via a sensor (neither of which are shown). Upon detecting a failure of main actuator 12 or a failure of control shaft 16 to rotate, the engine control module routes signals containing, for example, a stall indication, driver input and/or reset information to secondary actuator 14. Secondary actuator 14 rotates control shaft 16 in response to the signals from the engine control unit. Thus, if engine 17 has stalled due to, for example, a failure of main actuator 12, secondary actuator 14 is commanded to return the valve lift profile to a stall-recovery, engine restart, or idle position. Secondary actuator 14 responds by rotating control shaft 16 to thereby appropriately position oscillating cam lobe 46*a* relative to follower roller 72, and thereby set the valve lift profile of variable valve mechanism 30, for restarting engine 17. Once engine 17 is restarted, driver input is routed by the engine control unit to secondary actuator 14, which responds by adjusting the valve lift profile of variable valve mechanism 30 according to the driver input. Thus, secondary actuator 14 provides driver control over variable valve mechanism 30 in the event of a failure of main actuator 12 thereby enabling a driver to restart the vehicle, to "limp home", or to drive to the nearest repair station.

As stated above, secondary actuator 14 may optionally be selected to be of lower power and/or slower response speed than main actuator 14. Thus, the only effect noticeable by a driver due to the failure of main actuator 12 would be a decrease in the responsiveness of the throttle control system. In addition, a trouble indicator light or service engine soon light can be illuminated. If size, power, and weight constraints permit, secondary actuator 14 may be selected to be of sufficient power such that the effect of a failure of main actuator 12 would be minimally, if at all, perceptible to a driver without the illumination of a trouble indicator light.

In the embodiment shown, each of main actuator 12 and secondary actuator 14 are configured as DC motors. However, it is to be understood that the main actuator and secondary actuator may be alternately configured, such as, for example, hydraulic actuators.

In the embodiment shown, secondary actuator 14 is selected to be of lower power than main actuator 12. However, it is to be understood that secondary actuator 14 may be alternately configured, such as, for example, of the same power or higher powered than main actuator 12.

In the embodiment shown, main actuator 12 and secondary actuator 14 are configured as separate and distinct actuators. However, it is to be understood that the main actuator and secondary actuator may be alternately configured, such as, for example, separate windings within a single motor.

In the embodiment shown, secondary output gear 14*a* has, for example, four times as many teeth per inch relative to main output gear 12*a* and therefore has a small circular pitch relative to main output gear 12*a*. However, it is to be understood that secondary output gear 14*a* can be alternately configured, such as, for example, as having approximately the same circular pitch as main output gear 12*a* to having a substantially smaller circular pitch relative thereto.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. A variable valve mechanism, comprising:

a control shaft, said control shaft being rotatable to select a desired valve lift profile of at least one valve in said variable valve mechanism; and a variable valve actuator assembly, including;

a main actuator;

a secondary actuator; and an actuator shaft coupled to each of said main actuator and said secondary actuator, said main actuator and said secondary actuator each being separately and independently selectable for driving said actuator shaft to rotate, said actuator shaft being coupled to said control shaft such that rotation of said actuator shaft is transferred to said control shaft.

2. The variable valve mechanism of claim 1, wherein each of said main actuator and said secondary actuator comprise respective motors.

3. The variable valve mechanism of claim 1, wherein said main actuator and said secondary actuator comprise separate windings within a single motor.

4. The variable valve mechanism of claim 1, further comprising a main output gear, said main output gear coupling said actuator shaft to said control shaft such that rotation of said actuator shaft is transferred to said control shaft.

5. The variable valve mechanism of claim 4, further comprising a secondary output gear, said secondary output gear being selectively and directly driven to rotate by said secondary actuator, said secondary output gear being coupled to said actuator shaft such that rotation of said secondary output gear is transferred to said actuator shaft.

6. The variable valve mechanism of claim 5, further comprising a secondary shaft gear disposed on said actuator shaft, said secondary shaft gear coupling said secondary output gear to said actuator shaft.

7. The variable valve mechanism of claim 6, wherein said main output gear includes a plurality of first gear teeth having a first circular pitch, said secondary output gear includes a plurality of second gear teeth having a second circular pitch, said second circular pitch being less than said first circular pitch.

8. The variable valve mechanism of claim 7, wherein said second circular pitch is from approximately one-half to approximately one-tenth of said first circular pitch.

9. The variable valve mechanism of claim 1, wherein said secondary actuator is selected to be at least one of a lower power, smaller size and lighter weight than said main actuator.

10. An internal combustion engine, comprising:

a variable valve train mechanism having at least one intake valve;

a control shaft coupled to said variable valve mechanism, said control shaft being rotatable to select a desired valve lift profile of said at least one valve; and a variable valve actuator assembly, including;

a main actuator;

a secondary actuator; and an actuator shaft coupled to each of said main actuator and said secondary actuator, said main actuator and said secondary actuator each being separately and independently selectable for driving said actuator shaft to rotate, said actuator shaft being coupled to said control shaft such that rotation of said actuator shaft is transferred to said control shaft.

* * * * *